United States Patent [19]

Knudsen

[11] 3,973,504

[45] Aug. 10, 1976

[54] POWER AND FREE CONVEYOR SYSTEM

[75] Inventor: Kenneth F. Knudsen, St. Clair Shores, Mich.

[73] Assignee: American Chain & Cable Company, Inc., Bridgeport, Conn.

[22] Filed: Feb. 24, 1975

[21] Appl. No.: 552,533

[52] U.S. Cl. ..... 104/172 S; 104/89; 105/149; 211/1.5; 211/122; 211/162

[51] Int. Cl.[2] ..... B61B 13/12

[58] Field of Search ..... 104/172 R, 172 S, 89; 105/148, 149; 211/113, 116, 122, 162, 1.5; 294/67 R

[56] References Cited

UNITED STATES PATENTS

| | | | |
|---|---|---|---|
| 3,368,688 | 2/1968 | Weiss et al. | 211/122 X |
| 3,662,688 | 5/1972 | Desilets et al. | 104/172 S X |
| 3,854,573 | 12/1974 | Freier, Sr. | 104/172 S X |

*Primary Examiner*—L. J. Paperner
*Assistant Examiner*—Randolph A. Reese
*Attorney, Agent, or Firm*—Barnes, Kisselle, Raisch & Choate

[57] ABSTRACT

A power and free conveyor system comprising a power track, a conveyor movable along the power track, a carrier track, a plurality of carriers movable along the carrier track and interengaging members between the coveyor and the carriers. At least one module is provided and comprises a body having hooks on a back wall thereof. The carrier has a generally vertical central frame extending downwardly including spaced side portions which are generally vertically aligned with the carrier track. An upper pair of arms extends transversely from the central frame and a cross bar joins the arms. The module extends between the side portions of the central frame with the hooks engaging the cross bar. A pair of lower arms extends transversely from the central frame and a bar between the ends of the lower arms engages the back wall of the module to stabilize the module.

18 Claims, 9 Drawing Figures

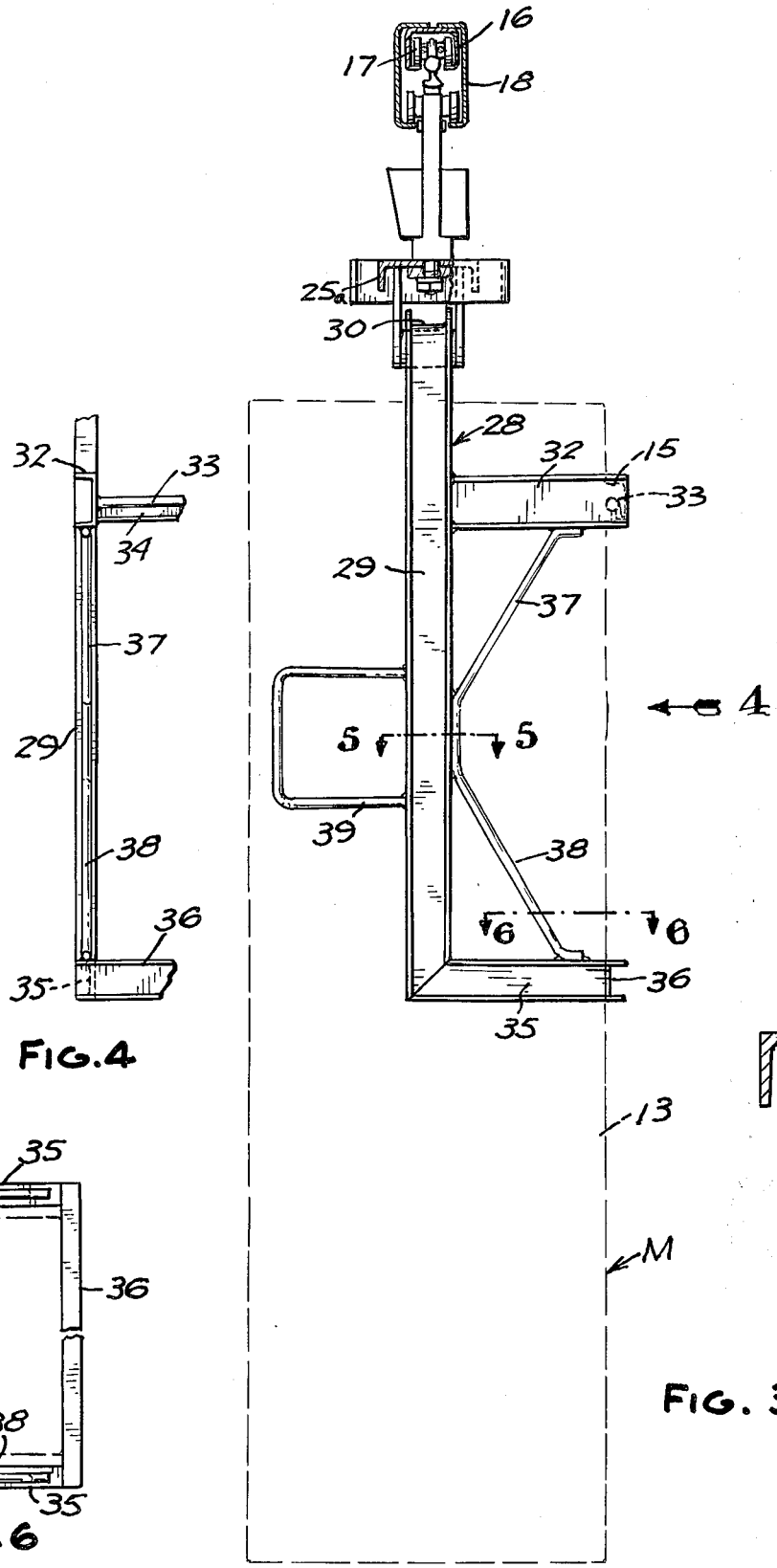
FIG. 3
FIG. 4
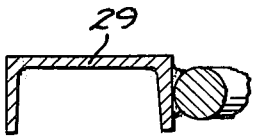
FIG. 5
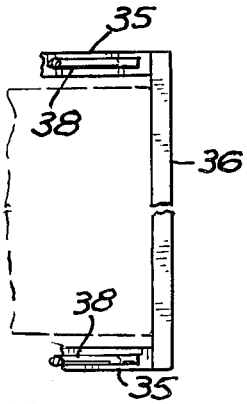
FIG. 6

POWER AND FREE CONVEYOR SYSTEM

This invention relates to power and free conveyor systems.

BACKGROUND OF THE INVENTION

In the handling of goods, it has been common to utilize a generally rectangular module which has hooks on a rear wall thereof so that the module can be hung on a cross bar in a room or the like. Such modules have heretofore been transported by hand trucks and the like.

It is an object of this invention to provide a power and free conveyor system which utilizes a novel carrier for transporting such a module from one location to another; wherein the carrier includes stabilizing means for stabilizing the movement of the module; and which carrier has means for insuring stability as the module is moved in inclined paths.

SUMMARY OF THE INVENTION

In accordance with the invention, the power and free conveyor system includes a carrier having a generally vertical central frame extending downwardly including spaced side portions which are generally vertically aligned with the free track. An upper pair of arms extends transversely from the central frame and a cross bar joins said arms. The module extends between the side portions of the central frame with the hooks thereon engaging the cross bar. A pair of lower arms extends transversely from the central frame and have contact means on the ends thereof engaging the rear wall of said module having said hook means thereon to stabilize the module.

DESCRIPTION OF THE DRAWINGS

FIG. 3 is a sectional view taken along the line 3—3 in FIG. 2.

FIG. 4 is a fragmentary view taken in the direction of the arrow 4 in FIG. 3.

FIG. 5 is a fragmentary sectional view on an enlarged scale taken along the line 5—5 in FIG. 3.

FIG. 6 is a fragmentary sectional view taken along the line 6—6 in FIG. 3.

DESCRIPTION

Figure 1:
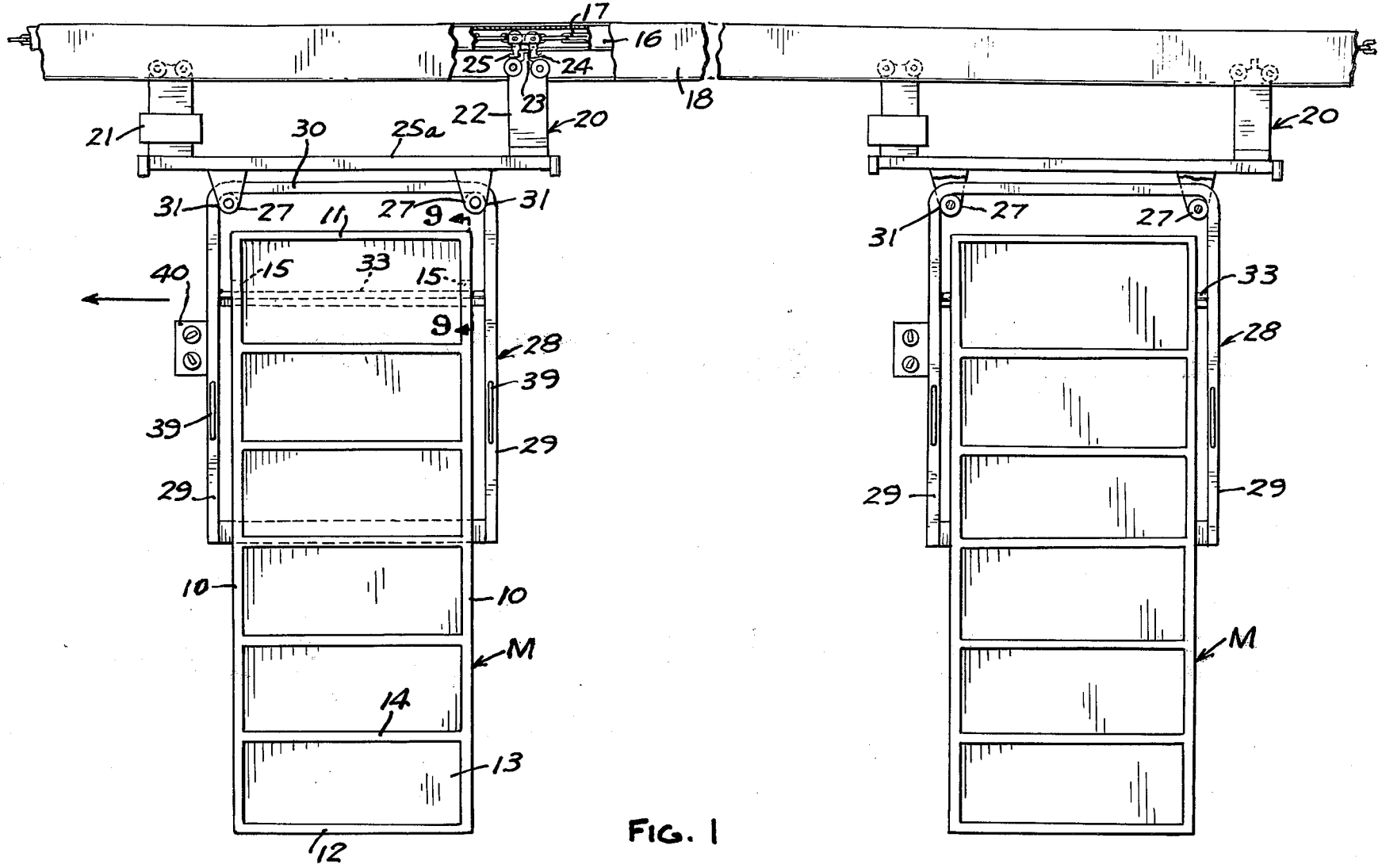
FIG. 1 is a fragmentary part sectional side elevational view of a power and free conveyor system embodying the invention.

Referring to FIG. 1, the invention relates to a power and free conveyor system particularly adapted for transporting modules M which have side walls 10, top and bottom walls 11, 12, and a rear wall 13. The module may further include adjustable shelves 14. In addition, the module has integral hooks 15 on the rear wall 13 which are commonly used to engage the module with the cross bar on the wall of the room in which the module is being used for storing various goods.

The power and free conveyor system embodying the invention comprises a power track 16 in which a chain conveyor 17 operates. The power track 16 is telescoped within a larger track 18, the lower portion of which forms a carrier or free track for a plurality of carriers 20. Each carrier 20 includes a front trolley 21 having wheels thereon engaging the track 18 and a rear trolley 22 similarly having wheels thereon. Interengaging means provided between the conveyor chain 17 and the rear trolley 22 in accordance with well-known construction comprise a pusher 23 which is trapped between a pusher dog 24 and a holdback dog 25 all in accordance with conventional construction as shown, for example, in U.S. Pat. No. 3,081,712.

Each carrier 20 further includes a tie bar **25*a* extending between the trolleys 21, 22. In addition, the carrier 20 includes brackets 26 that extend downwardly from longitudinally spaced points on the tie bar 25*a* to support rollers 27 that have their axes extending horizontally and transversely of the path of movement of the carrier. Each carrier further includes a central frame 28 that is made of a single piece of metal having a channel-shaped cross section and includes vertical side portions 29 connected by a horizontal central portion 30. At the areas of juncture 31 of the side portions 29 and horizontal portion 30, the frame 28 is curved for engagement with the rollers 27.**

Referring to FIG. 3, the carrier 28 further includes upper transverse arms 32 that extend from the side portions 29 of the central frame 28 and have a cross bar 33, having a circular cross section, extending between their free ends. An angle 34 reinforces the cross bar 33 so that it will support the load when the hooks 15 on the module M engage the cross bar.

The central frame 28 further includes lower transverse arms 35 that extend in the same direction as the upper arms 32 and have their free ends interconnected by a bar 36 that forms contact means for the intermediate portion of the rear wall 13 of the module M.

In order to further increase the strength of the frame 28, struts 37, 38 are formed between the side arms 32, 35 and the side portions 29 by bending and welding a single rod to the respective arms and portions.

In addition, rectangular handles 39 are provided on the side portions 29 and extend transversely in directions opposite to the side arms 32, 35 to facilitate the mounting and removal of the module M from the carrier 20.

The carrier further may include destination code means 40 in accordance with conventional construction.

In operation, the module M is lifted manually or by an elevator truck to a position between the side portions 29 to bring the hooks 15 into position for engagement with the cross bar 33. When the module M is so suspended, the intermediate portion of the rear wall 13 engages the bar 36 thereby stabilizing the module M within the carrier. The interaction of the cross bar 33 and bar 36 forms a force couple that stabilizes the load and insures its vertical movement along the track.

Figure 2:
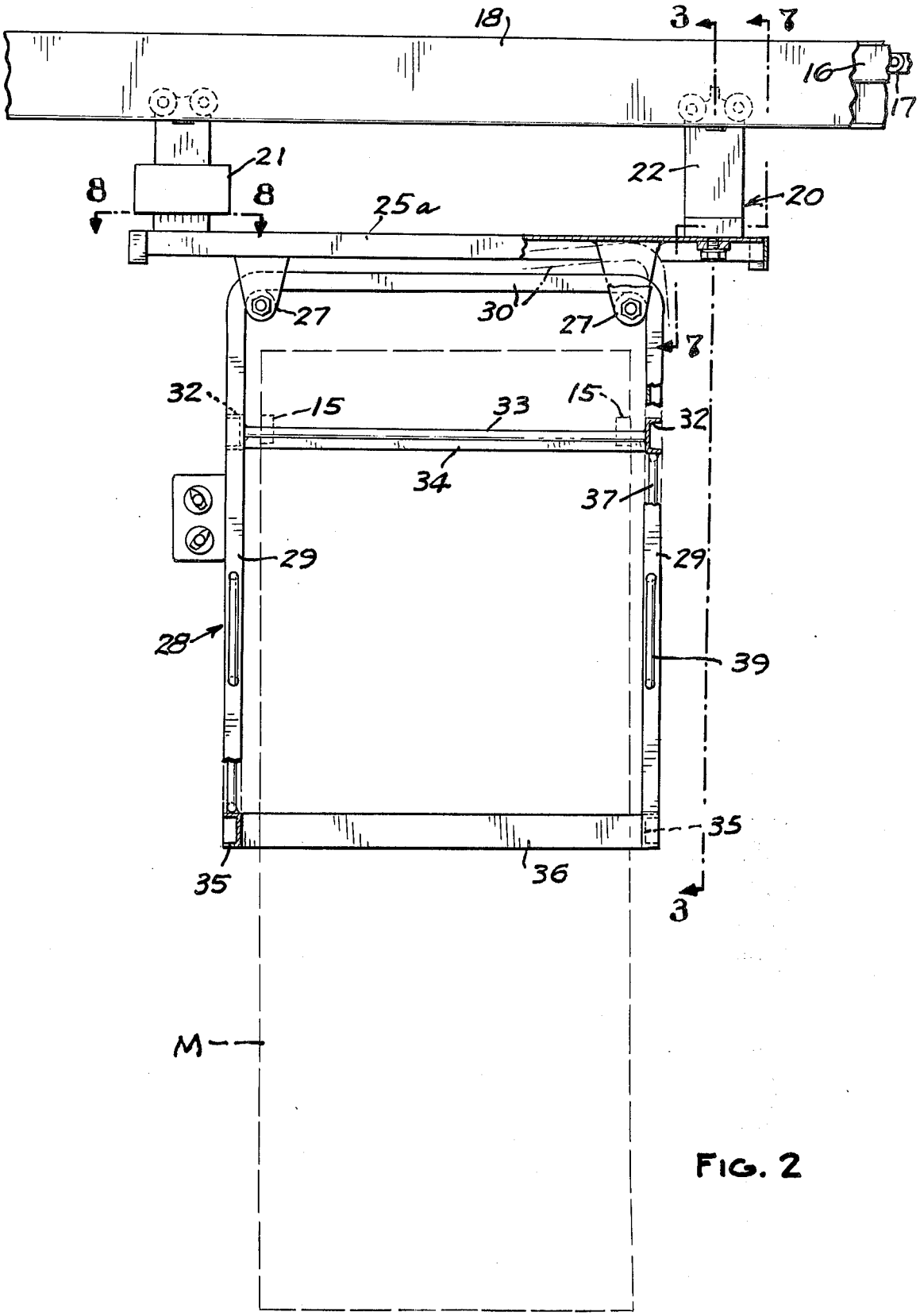
FIG. 2 is a fragmentary view similar to FIG. 1 on an enlarged scale with the module removed.
Figure 8:
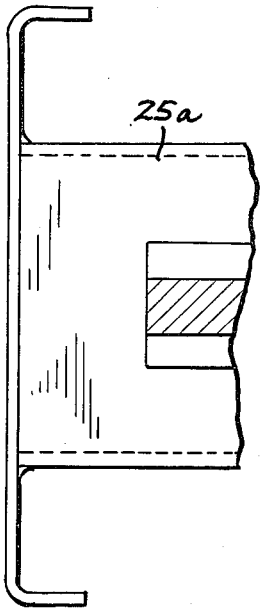
FIG. 8 is a fragmentary sectional view on an enlarged scale taken along the line 8—8 in FIG. 2.
Figure 7:
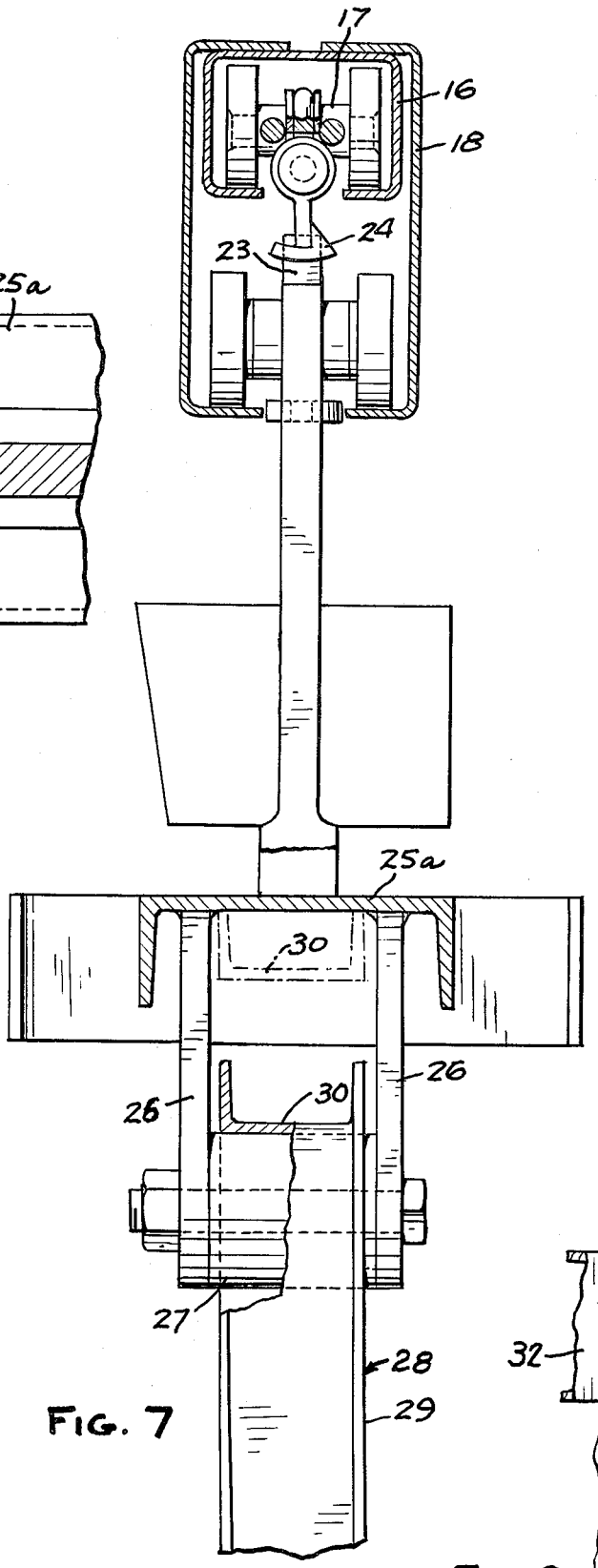
FIG. 7 is a fragmentary sectional view on an enlarged scale taken along the line 7—7 in FIG. 2.
Figure 9:
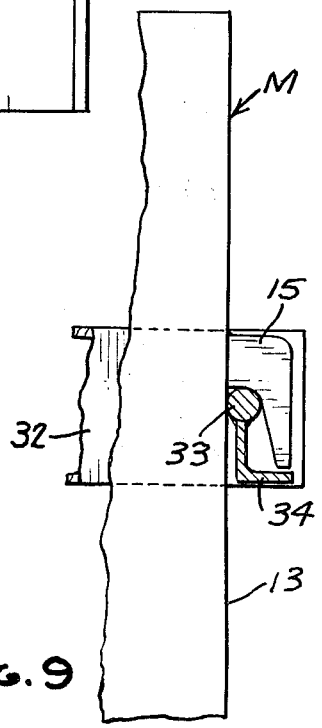
FIG. 9 is a fragmentary sectional view on an enlarged scale taken along the line 9—9 in FIG. 1.

When a portion of the track is inclined, gravity will cause the frame 28 to be lifted, as shown in broken lines in FIG. 2, so that the load is maintained vertical within the limits of space between the rollers 27 and the bar 25A.

I claim:

1. In a power and free conveyor system, the combination comprising a power track, a conveyor movable along said power track, a carrier track, a plurality of carriers movable along said carrier track, interengaging means between said conveyor and said carriers, at least one module comprising a generally rectangular body having hook means on a rear wall thereof, said carrier having a generally vertical central frame extending downwardly including longitudinally spaced side portions extending downwardly, said frame having portions thereof extending transversely from said central frame and a cross bar extending therebetween longitudinally of said carrier, said cross bar being spaced transversely from said frame, said carrier having the space between said side portions unobstructed to receive said module, said module extending between said side portions of said frame with said hook means engaging said cross bar, said carrier having additional portions thereof extending transversely from said frame spaced vertically below said cross bar and having contact means thereon engaging said rear wall of said module having said hook means thereon to stabilize said module such that said module is supported and stabilized solely by said cross bar and said contact means.

2. The combination set forth in claim 1 wherein said frame includes a central portion connecting the upper ends of said side portions.

3. The combination set forth in claim 2 wherein the area of juncture of said side portions and said central portion is curved, said carrier having longitudinally spaced rollers thereon engaging said frame at said curved areas of juncture such that said frame has limited vertical movement with respect to the remainder of the carrier at said areas of juncture.

4. The combination set forth in claim 1 wherein said contact means on said frame comprises a bar.

5. The combination set forth in claim 1 wherein said cross bar has a circular cross section.

6. The combination set forth in claim 1 including handles extending transversely from said frame in a direction opposite to that of said transversely extending portions of said frame to form a means of gripping said frame during loading and unloading of a module thereon.

7. In a power and free conveyor system, the combination comprising a power track, a conveyor movable along said power track, a carrier track, a plurality of carriers movable along said carrier track, interengaging means between said conveyor and said carriers, at least one module comprising a body having hook means on a rear wall thereof, said carrier having a generally vertical central frame extending downwardly including longitudinally spaced side portions, said side portions being generally vertically aligned with the carrier track, an upper pair of arms extending transversely from said central frame and a cross bar joining said arms, said cross bar being spaced transversely from said frame, said carrier having the space between said side portions unobstructed to receive said module, said module extending between said side portions of said frame with the hook means engaging said cross bar, a pair of lower arms extending transversely from said frame and having contact means on the ends thereof engaging said rear wall of said module having said hook means thereon to stabilize said module such that said module is supported and stabilized solely by said cross bar and said contact means.

8. The combination set forth in claim 7 wherein said central frame includes a generally horizontal central portion connecting the upper ends of said side portions.

9. The combination set forth in claim 8 wherein the area of juncture of said side portions and central portion is curved, said carrier having spaced rollers thereon engaging said central frame at said curved areas of juncture such that the frame has limited vertical movement with respect to the remainder of the carriers at said areas of juncture.

10. The combination set forth in claim 7 wherein said contact means on said lower arms comprises a bar.

11. The combination set forth in claim 7 wherein said cross bar has a circular cross section.

12. The combination set forth in claim 7 including handles extending transversely from said side portions of said frame in a direction opposite to that of said upper and lower side arms to form a means of gripping said frame during loading and unloading of a module thereon.

13. For use in a power and free conveyor system comprising a power track, a conveyor movable along said power track, a carrier track, a carrier adapted to move along said carrier track and having means thereon adapted to interengage said conveyor, said carrier having a generally vertical central frame extending downwardly including spaced side portions, said side portions being generally vertically aligned with the carrier track, an upper pair of arms extending transversely from said central frame and a cross bar joining said arms, said cross bar being spaced transversely from said frame, said carrier having the space between said side portions unobstructed to receive a module, such that the module may extend between said side portions of said frame with hook means on said module engaging said cross bar, and a pair of lower arms extending transversely from said frame and having contact means on the ends thereof adapted to engage the wall of said module which has said hook means thereon to stabilize the module such that said module is supported and stabilized solely by said cross bar and said contact means.

14. The combination set forth in claim 13 wherein said frame includes a central portion connecting the upper ends of said side portions.

15. The combination set forth in claim 14 wherein the area of juncture of said side portions and central portion is curved, said carrier having spaced rollers thereon engaging said frame at said curved areas of juncture such that the frame has limited vertical movement with respect to the remainder of the carrier at said areas of juncture.

16. The combination set forth in claim 13 wherein said contact means on said lower side arms comprises a bar.

17. The combination set forth in claim 13 wherein said cross bar has a circular cross section.

18. The combiantion set forth in claim 13 including handles extending transversely from said frame in a direction opposite to that of said upper and lower side arms to form a means of gripping said frame during loading and unloading of a module thereon.

* * * * *